United States Patent [19]

Fullenkamp et al.

[11] 4,314,735

[45] Feb. 9, 1982

[54] BED LOCATOR HAVING AN INTEGRAL ELECTRIC SOCKET AND A PLUG EJECTOR

[75] Inventors: Eugene Fullenkamp, Batesville; Dale Foster, Brookville, both of Ind.

[73] Assignee: Hill-Rom Company, Inc., Batesville, Ind.

[21] Appl. No.: 136,505

[22] Filed: Apr. 3, 1980

[51] Int. Cl.[3] ..... H01R 13/62

[52] U.S. Cl. ..... 339/45 R; 5/508; 248/346.1

[58] Field of Search ..... 339/45 R, 45 M, 45 T; 5/503, 508; 248/346.1

[56] References Cited

U.S. PATENT DOCUMENTS

| | | | |
|---|---|---|---|
| 2,580,598 | 1/1952 | Rody | 5/508 X |
| 3,936,123 | 2/1976 | Gossett et al. | 339/45 R X |
| 4,042,292 | 8/1977 | Chensky | 339/45 R |

*Primary Examiner*—Howard N. Goldberg
*Assistant Examiner*—Frank H. McKenzie, Jr.
*Attorney, Agent, or Firm*—Burns, Doane, Swecker & Mathis

[57] ABSTRACT

A floor-mounted bed locator is used to removably retain a hospital bed of the type which carries electrically powered equipment having an electric plug. The locator comprises an electrical socket for receiving the plug, and a disconnector for ejecting the plug from the socket when the bed is removed from the locator. The disconnector includes at least one ejector pin disposed beneath the plug when the latter is connected to the socket, and a movably mounted treadle engageable and moved by a castor of the bed as the latter is removed from the locator to lift said pin into pushing engagement with the plug.

13 Claims, 7 Drawing Figures

BED LOCATOR HAVING AN INTEGRAL ELECTRIC SOCKET AND A PLUG EJECTOR

BACKGROUND AND OBJECTS OF THE INVENTION

The present invention relates to bed locators, especially of the floor-mounted type, for orienting beds that carry electrically powered equipment and, in particular, to a locator which incorporates an electrical coupling for such electrical equipment.

Beds which contain electrically powered equipment are common, especially in hospitals. For example, such beds may contain electric motors which articulate or elevate the sleeping surface. The motors are adapted for connection to a standard electrical system and, to this end, include an electric cord and plug to be connected to a conventional receptacle or socket.

Such a bed may also carry other occupant-controlled equipment, such as intercom units, television and lighting remote controls, etc., which receive electrical power via a cord and plug.

In many instances, especially in hospital use, a bed is intended to remain in a preselected location and orientation within the room. To accomplish this, a castor of the bed may be removably retained within a floor-mounted locator. A typical locator includes a ramp onto which the castor is pushed, and a recessed area at the end of the ramp to retain the castor. Thus, during normal use, the bed is retained in the locator, and the plug for the electrical equipment is coupled to an electrical socket.

On occasion, it will be necessary to relocate the bed and thereby remove the castor from the locator. In so doing, it may occur that the plug is left in the socket while the bed is moved and is forcefully yanked from the socket such that the plug and/or socket can become damaged. Such an event can leave the patient temporarily without the use of the various electrical equipment, as well as giving rise to repair costs.

Therefore, it is an object of the present invention to minimize or obviate the problems of the above-mentioned type.

Another object of the present invention is to minimize chances that damage may occur to the plug/-socket coupling of bed-mounted electrical equipment.

It is a further object of the invention to assure that the plug/socket coupling is safely uncoupled automatically upon moving a bed.

It is a further object of the invention to provide such a plug/socket which provides a fluid-tight coupling when coupled.

It is an additional object of the invention to assure that the socket is automatically covered upon disengagement of the plug.

BRIEF SUMMARY OF THE INVENTION

These objects are achieved by the present invention which relates to a bed locator for use with a bed of the type which includes a leg to be removably retained by the locator and which carries electrically powered equipment having a first electrical connector. The locator comprises a second electrical connector electrically connectible to the first connector to connect electrically actuable equipment to a source of electric power. The locator also includes a disconnector mechanism actuated in response to removal of the bed leg from the locator for disconnecting the first and second connectors.

Preferably, the disconnector mechanism comprises a swingable treadle which is swung in response to the bed leg riding thereover, and a plurality of ejector pins which are raised by the treadle into pushing engagement with the first connector.

THE DRAWING

The objects and advantages of the invention will become apparent from the following detailed description of a preferred embodiment thereof, in connection with the accompanying drawing in which like numerals designate like elements, and in which.

DETAILED DESCRIPTION OF A PREFERRED EMBODIMENT OF THE INVENTION

Figure 4:
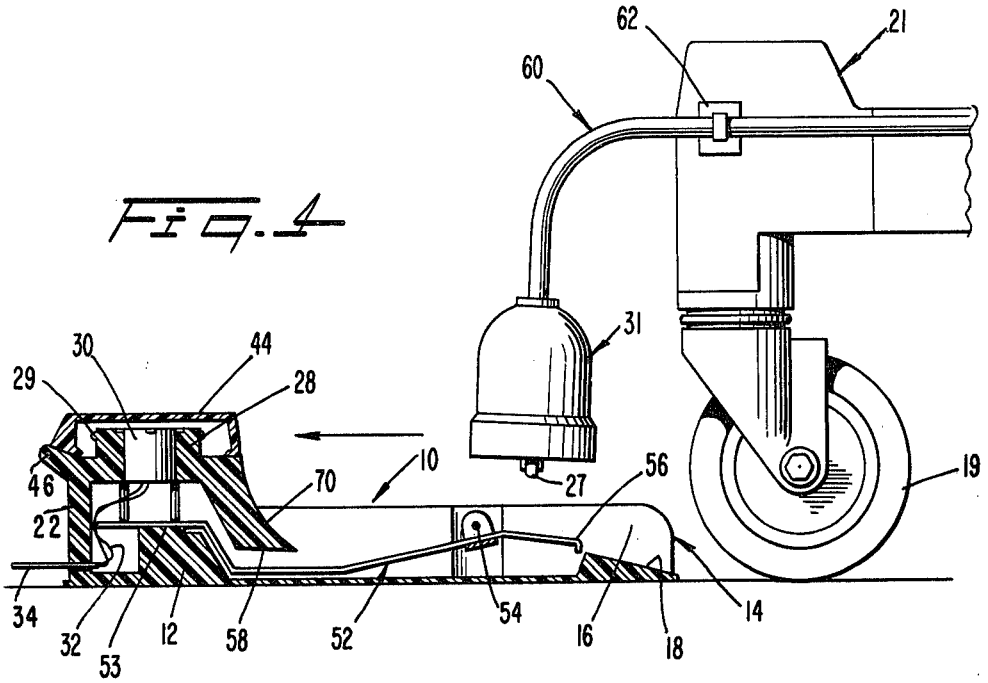
FIG. 4 is a view of the locator and a bed being moved theretoward, the locator being shown in longitudinal section.

A preferred bed locator 10 according to the present invention comprises a housing 12 adapted to be fixedly mounted to a floor, such as the floor of a hospital room, in any suitable manner. The housing can be formed of any suitable material such as steel, aluminum, plastic, etc. The locator is to be used in conjunction with a bed 21 having a leg, preferably which carries a castor 19, in order to removably retain the bed in a selected location. In this regard, the housing 12 includes a front portion 14 having upright side walls 16 whose front ends 17 diverge on opposite sides of an inclined ramp 18 upon which the castor 19 may roll (FIG. 4).

Figure 5:
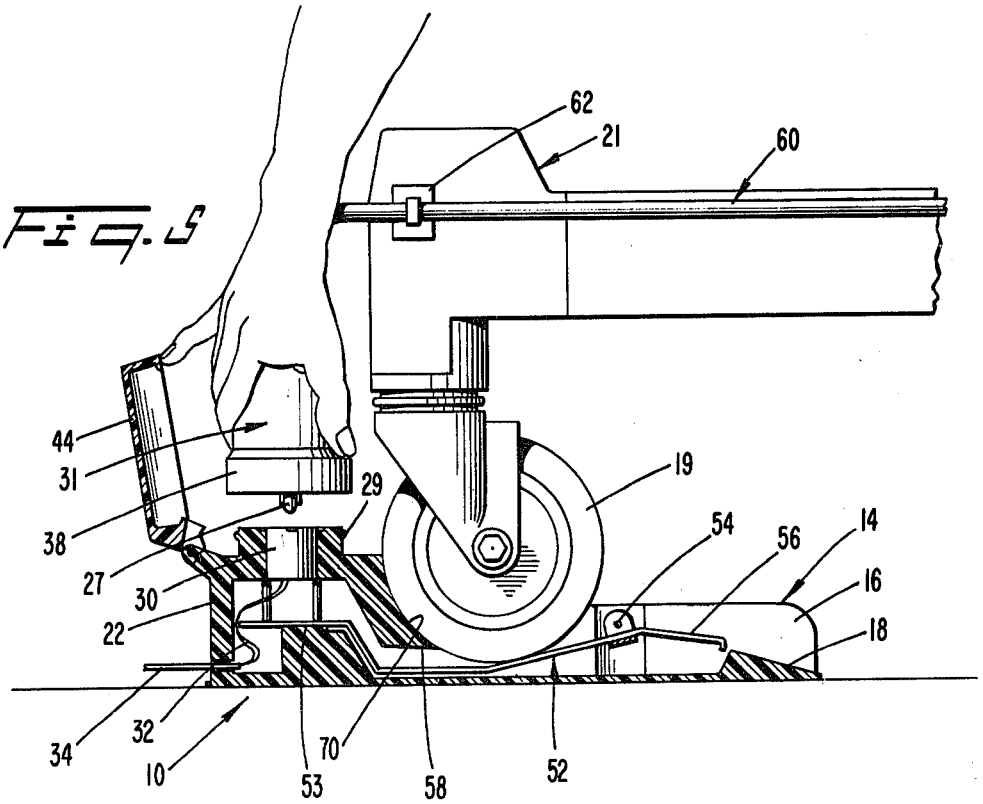
FIG. 5 is a view similar to FIG. 4 depicting the condition of the locator after the bed castor has been rolled thereon and a plug is being inserted into the socket of the locator.

The housing has a rear end 20 which includes an upright rear wall 22 (FIG. 2), a pair of upright side walls 24, a top wall 26, and a front wall 27. The top wall 26 includes an upstanding cylindrical neck 28 having a lip 29 extending around the upper end thereof. Mounted within the top wall 26 is a high voltage electric connector socket or receptacle 30 of a conventional type adapted to receive the prongs 27 of a connector plug 31 (FIG. 5) of electrically actuated equipment. Such equipment may comprise motors carried by the bed 21 for articulating or elevating the sleeping surface. Insulated electrical conductors 32 are connected to the socket and are connected to a source of electrical power via a cable 34 which projects through an opening 36 in the rear wall 22.

The plug 30 contains a rubber boot 38 or the like which has a collar portion 40 adapted to surround the neck 28 (FIG. 6) and a recess 42 for receiving the lip 29 of the neck 28 in order to create a fluid-tight seal around the socket when the electrical coupling is engaged.

Figure 1:
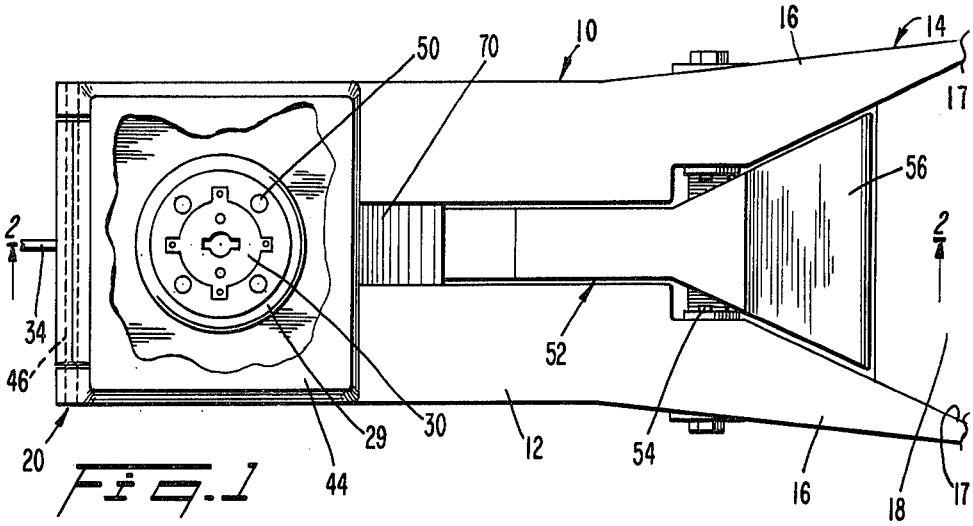
FIG. 1 is a plan view of a bed locator according to the present invention, with a portion of a cover thereof broken away to expose a socket thereof.
Figure 2:
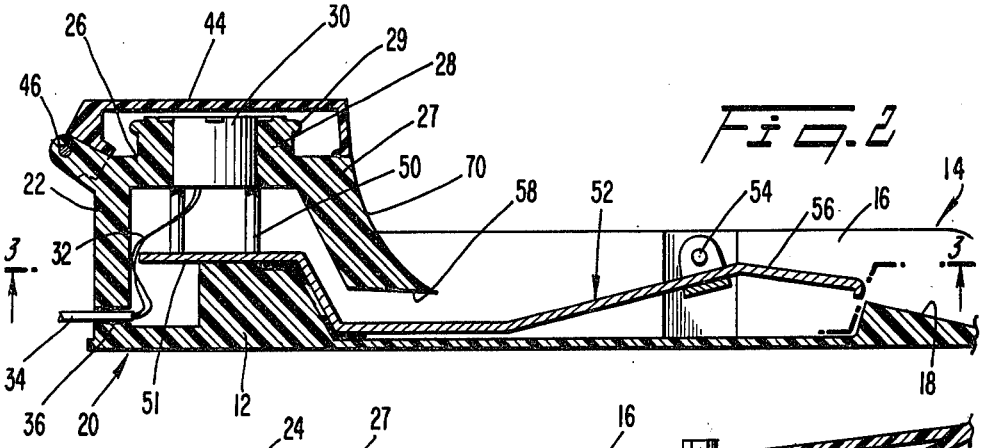
FIG. 2 is a longitudinal sectional view of the locator taken along line 2—2 of FIG. 1.
Figure 3:
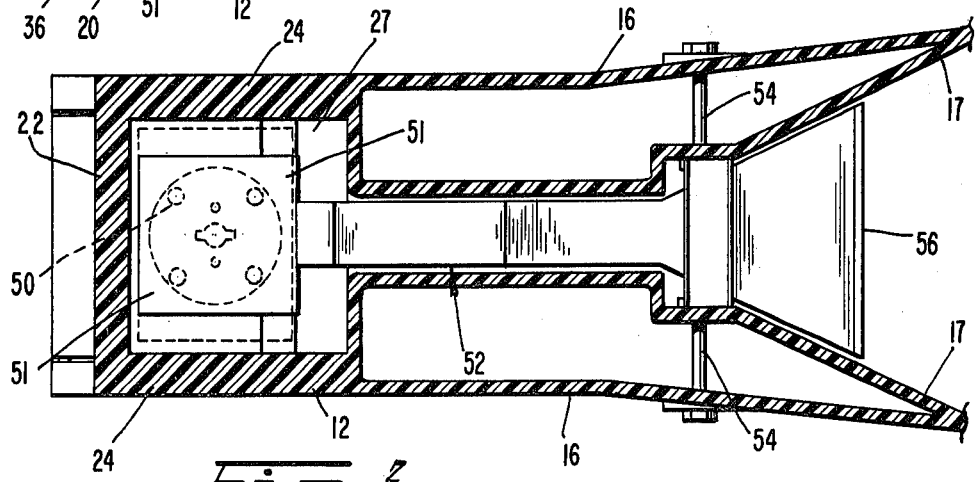
FIG. 3 is a sectional view of the locator taken alone line 3—3 in FIG. 2 so as to view a treadle portion from below.
Figure 6:
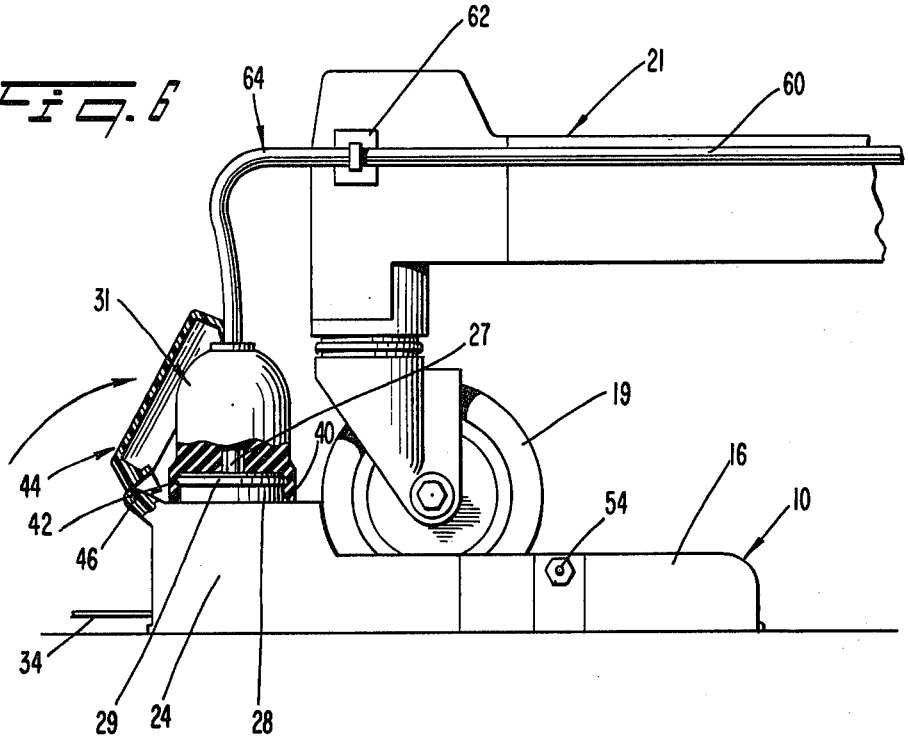
FIG. 6 is a view similar to FIG. 4 showing the locator in its normal condition of use after the plug has been inserted.

A cover 44 is hinged at 46 to the rear wall 22 for swinging movement about a horizontal axis. The hinge may include a conventional torsion spring (not shown) to bias the cover 44 to a downward closed position against the top wall 26 (FIGS. 1, 2). When the cover is in an upright open position (FIGS. 5–7), the plug 31 may be coupled to the socket 30 and thereafter hold the cover in its open position (FIG. 6).

The locator 10 further includes a disconnector mechanism which is actuated in response to removal of the bed castor 19 from the locator 10 to disconnect the plug and socket in a non-destructive manner to prevent the occurrence of damage thereto.

The disconnector mechanism comprises a plurality of upright ejector pins 50 mounted for vertical sliding movement within vertical apertures in the top wall 26. Preferably, there are two pairs of such pins 50 mounted on diagonally opposite sides of the socket 30.

Lower ends of the pins 50 rest atop a rear end 51 of a treadle 52. The treadle 52 is in the form of a lever which is pivoted at 54 intermediate its ends for swinging movement about a horizontal axis defined by the pivot. A front end 56 of the treadle is disposed at an upper end of the ramp 18 and generally forms a continuation thereof. The rear end 51 of the treadle normally rests upon a surface 53 of the housing 12. A castor 19 passing over the front end 56 of the treadle will rotate the treadle about the axis 54 such that the rear end of the treadle rises.

The treadle passes beneath a lower end 58 of the front wall 27 and is vertically displaceable therebeneath. Such lower end 58 of the front wall 27 functions as an upper stop for the treadle, as will become apparent.

When the rear end 51 of the treadle rises, the pins 50 are lifted from beneath, whereby the top ends of the pins, normally disposed generally flush with the upper surface of the neck 28, abut against the plug 31 and push it from the socket 30. Accordingly, the treadle 52 ejects the plug 31 in response to removal of the castor 19 from the locator 10. That is, as the castor 19 travels forwardly of the treadle pivot 54, and onto the forward treadle portion 56, the latter is depressed, i.e., the treadle 52 swings clockwise as viewed in FIG. 7, whereby the rear end 51 of the treadle rises to lift the ejector pins 50. When the castor leaves the treadle 52 and enters the ramp 18, the treadle and pins return to their rest position, allowing the spring-biased cover 44 to swing shut to close-off the socket.

The electrical cord 60 of the plug 31 is preferably connected to the bed 21 via a clip retainer 62, whereby only a relatively short portion 64 of the cord projects from the bed. This prevents the cord and plug from lying on the floor where they are susceptible to damage.

In addition to the high voltage socket 30, the locator may contain one or more low voltage sockets which can be provided for connection to electrical equipment such as intercoms, television controls and the like. In this regard, the plug may contain additional prongs which enter such low voltage socket and thus are also disconnected in response to removal of the castor from the locator.

Figure 7:
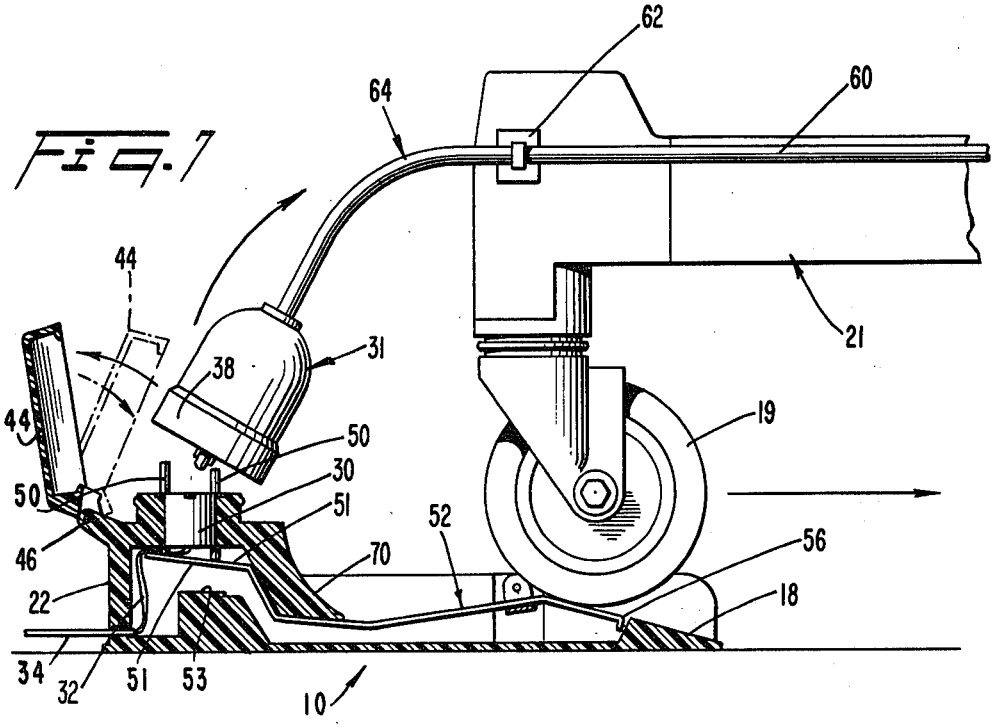
FIG. 7 is a view similar to FIG. 6 depicting the plug being ejected by ejector pins of the locator in response to the castor rolling along the treadle during a bed-removal step.

In operation, the bed castor 19 is normally retained in a "docked" condition within the locator, wherein the castor rests against the treadle 52 and a front curved surface 70 of the front wall 27. The plug 31 and socket 30 are interconnected to supply power to equipment carried by the bed. When the bed and its castor 19 are removed from the locator 10, the castor travels onto the front end 56 of the treadle 42, thereby rotating the treadle about its pivot axis 54 such that the rear end 51 of the treadle is raised. Accordingly, the ejector pins 50 are lifted and push the plug 31 from the socket 30 (FIG. 7). Thereupon, the spring-biased cover 44 snaps shut to close-off the socket 30 (FIG. 2). After the castor 19 has subsequently been reinserted into the locator 10, the cover 44 can be raised to expose the socket 30 for reception of the plug 31. When the plug 31 is pushed into the socket 30, the recess 42 of the boot 38 receives the lip 29 of the neck 28 to provide a seal around the electrical connection (FIG. 6).

It should be noted that in lieu of a spring-biased hinge for the cover 44, a suitable linkage (not shown) can be provided which interconnects the treadle and cover to automatically open the cover when the castor is inserted into the locator and close the cover when the castor is removed.

It will be appreciated that by virtue of the present invention, the plug/socket coupling is automatically disconnected in a non-destructive manner in response to the bed being removed from the locator. Accordingly, damage to the plug/socket coupling is prevented. Moreover, a protective seal is automatically established for the socket when the plug is coupled to, or removed from, the socket.

Although the invention has been described in connection with a preferred embodiment thereof, it will be appreciated by those skilled in the art that additions, substitutions, deletions and modifications not specifically described, may be made without departing from the spirit and scope of the invention as defined in the appended claims.

What is claimed is:

1. A bed locator for use with a bed of the type which includes a leg to be removably retained by the locator and which carries electrically powered means having a first electrical connector, said locator comprising:

a second electrical connector electrically connectible to said first connector to connect the electrically actuable means to a source of electric power, and disconnector means actuated in response to removal of said leg from the locator for disconnecting said first and second connectors.

2. Apparatus according to claim 1, wherein said disconnector means comprising an actuator displaced by said leg as the latter is removed from the locator, and at least one ejector element shifted by said actuator into contact with said first connector to eject the latter from said second connector.

3. Apparatus according to claim 2, wherein said actuator comprises a pivoted treadle having one end positioned to be depressed by said leg as the latter is removed from the locator, and another end which is raised when said one end is depressed, to force said ejector element upwardly against said first connector.

4. Apparatus according to claim 3, wherein said at least one ejector element comprises a plurality of pins seated on said other end of said treadle and liftable by the latter.

5. Apparatus according to claim 1, wherein said locator further includes a cover which automatically closes over the second electrical connector when said first and second connectors are disconnected.

6. Apparatus according to claim 1, wherein said first electrical connector comprises a plug having a flexible boot disposed therearound, said second electrical connector comprising a socket, said boot being configured to snap onto said locator when said plug is connected to said socket to provide a seal around the electrical connection.

7. Apparatus according to claim 6, wherein said boot includes an internal annular recess and said locator includes an annular lip, said lip being received in said recess when said plug is inserted into said socket.

8. A floor-mounted bed locator for use with a hospital bed of the type which includes a leg castor to be removably retained within the locator, and which carries electrically powered means having an electric plug, said locator comprising:

an electrical socket for receiving the plug, and disconnector means for ejecting the plug from said socket when the castor is removed from said locator and comprising:

at least one ejector pin disposed beneath the plug when the latter is connected to said socket, and a movably mounted treadle engageable and moved by the castor as the latter is removed from the locator to lift said pin into pushing engagement with the plug.

9. Apparatus according to claim 8, wherein said at least one pin comprises a plurality of pins freely vertically slidable in said locator adjacent said socket, and disposed over a rear end of said treadle, said treadle being pivotably mounted intermediate its front and rear ends, said front end arranged such that the castor rides therealong during travel onto or from said locator.

10. Apparatus according to claim 8, wherein said locator further comprises a cover which automatically closes over said socket upon disconnection of said plug and socket.

11. Apparatus according to claim 8, wherein said plug includes a flexible boot configured to attach onto said locator to form a seal around the electrical connection.

12. Apparatus according to claim 11, wherein said boot includes an internal annular recess, said locator including a lip disposed around said socket, said lip being received in said recess to define said seal.

13. A bed locator for use with a hospital bed of the type which includes a leg castor to be removably retained by the locator and which carries electrically actuable means having an electric cord and plug, said locator comprising:

a housing including at one end a ramp upon which the bed castor rides, and carrying a vertically oriented electrical socket at another end for receiving the plug, a treadle pivoted intermediate its ends to said frame and including a first end positioned adjacent said ramp and defining a continuation thereof, and a second end, a plurality of ejector pins vertically slidable in said housing adjacent said socket and arranged to lie beneath the plug when the latter is in connection with said socket, said pins disposed over said second end of said treadle and normally seated thereon so as to be raised thereby into pushing contact with said plug when the bed castor rides upon said first end of said treadle, to push said plug from said socket, and a cover connected to said housing to automatically close over said socket upon disconnection of said plug and socket.

* * * * *